United States Patent [19]

Studebaker et al.

[11] 4,192,553

[45] Mar. 11, 1980

[54] METHOD FOR ATTENUATING SEISMIC SHOCK FROM DETONATING EXPLOSIVE IN AN IN SITU OIL SHALE RETORT

[75] Inventors: Irving G. Studebaker; Richard Hefelfinger, both of Grand Junction, Colo.

[73] Assignee: Occidental Oil Shale, Inc., Grand Junction, Colo.

[21] Appl. No.: 892,736

[22] Filed: Apr. 3, 1978

[51] Int. Cl.[2] ..... E21C 41/10

[52] U.S. Cl. ..... 299/2; 102/23; 181/296

[58] Field of Search ..... 299/2, 13; 102/23, 30; 181/296

[56] References Cited

U.S. PATENT DOCUMENTS

| | | | |
|---|---|---|---|
| 2,704,515 | 3/1955 | Barlow | 102/23 |
| 2,846,205 | 8/1958 | Bucky | 299/13 X |
| 3,165,916 | 1/1965 | Loving et al. | 73/35 |
| 3,397,756 | 8/1968 | Andrews et al. | 299/13 X |
| 3,917,346 | 11/1975 | Janssen | 299/13 |

*Primary Examiner*—Ernest R. Purser
*Attorney, Agent, or Firm*—Christie, Parker & Hale

[57] ABSTRACT

In situ oil shale retorts are formed in formation containing oil shale by excavating at least one void in each retort site. Explosive is placed in a remaining portion of unfragmented formation within each retort site adjacent such a void, and such explosive is detonated in a single round for explosively expanding formation within the retort site toward such a void for forming a fragmented permeable mass of formation particles containing oil shale in each retort. This produces a large explosion which generates seismic shock waves traveling outwardly from the blast site through the underground formation. Sensitive equipment which could be damaged by seismic shock traveling to it straight through unfragmented formation is shielded from such an explosion by placing such equipment in the shadow of a fragmented mass in an in situ retort formed prior to the explosion. The fragmented mass attenuates the velocity and magnitude of seismic shock waves traveling toward such sensitive equipment prior to the shock wave reaching the vicinity of such equipment.

17 Claims, 5 Drawing Figures

METHOD FOR ATTENUATING SEISMIC SHOCK FROM DETONATING EXPLOSIVE IN AN IN SITU OIL SHALE RETORT

BACKGROUND

This invention relates to in situ recovery of shale oil and, more particularly, to techniques for attenuating seismic shock produced when detonating large mounts of explosive for forming an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which, upon heating, decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supply hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting." Such decomposition in the oil shale produces gaseous and liquid products, including gaseous and liquid hydrocarbon products, and a residual solid carbonaceous material.

The liquid products and the gaseous products are cooled by the cooled oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred herein as "liquid and gaseous products."

U.S. Pat. No. 4,043,595 discloses a method for explosively expanding formation containing oil shale to form an in situ oil shale retort. According to a method disclosed in that patent, formation within a retort site is excavated to form a columnar void bounded by unfragmented formation having a vertically extending free face. Blasting holes are drilled adjacent the columnar void and parallel to the free face. In one embodiment the columnar void is cylindrical and the blasting holes are arranged in concentric rings around the columnar void. In another embodiment, the columnar void is a slot having large parallel, planar vertical free faces toward which the formation in the retort site can be explosively expanded. The blasting holes are arranged in planes parallel to such free faces. Explosive is loaded in the blasting holes and detonated in a single round. This produces a large explosion which explosively expands the formation adjacent the columnar void toward the free face to form a fragmented permeable mass of formation particles containing oil shale which occupy the columnar void and the space in the retort site occupied by unfragmented formation prior to such explosive expansion.

Explosive in such blasting holes is detonated in a time-delay sequence so that unfragmented formation within the retort site is explosively expanded in segments progressing away from the free face provided by the columnar void. The sequence of blasting is rapid, and in an embodiment disclosed in U.S. Pat. No. 4,043,595, the time-delays for explosively expanding formation toward the columnar void span a time period of less than 700 ms. Shorter time-delays can be used in other embodiments. In one embodiment, as much as 85 tons of explosive are detonated in a single round for explosively expanding formation toward a columnar void. This produces a powerful explosion which generates seismic shock waves traveling outwardly through unfragmented formation extending away from the blasting site. Seismic shock from such a powerful explosion can cause serious damage to equipment and structures located in underground workings near the blast site. Equipment which can be damaged from such seismic shock cannot necessarily be easily or economically removed from underground workings prior to such explosive expansion. Thus, there is a need to attenuate the seismic effect on sensitive equipment in underground workings caused by detonating large amounts of explosive for forming an in situ oil shale retort.

SUMMARY OF THE INVENTION

Briefly, the present invention provides techniques for inhibiting damage to equipment which is sensitive to seismic shock caused by detonating explosive in a subterranean formation containing oil shale when forming a fragmented permeable mass of formation particles containing oil shale in an in situ oil shale retort. Such equipment is placed in underground workings located adjacent a first fragmented permeable mass of formation particles containing oil shale in a first in situ oil shale retort. The first fragmented mass shields such equipment from a seismic shock wave traveling directly toward such equipment from an explosion caused when detonating explosive for forming a second fragmented mass in a second in situ oil shale retort site spaced from the first fragmented mass. The first fragmented mass attenuates the shock velocity and magnitude of the seismic shock wave prior to the shock wave reaching unfragmented formation in the vicinity of the underground workings containing such equipment. In other words, sensitive equipment is placed in the shadow of an already formed in situ retort when another retort is formed by explosive expansion.

DRAWINGS

Features of specific embodiments of the best mode contemplated for carrying out the invention are illustrated in the drawings, in which.

DETAILED DESCRIPTION

Figure 1:
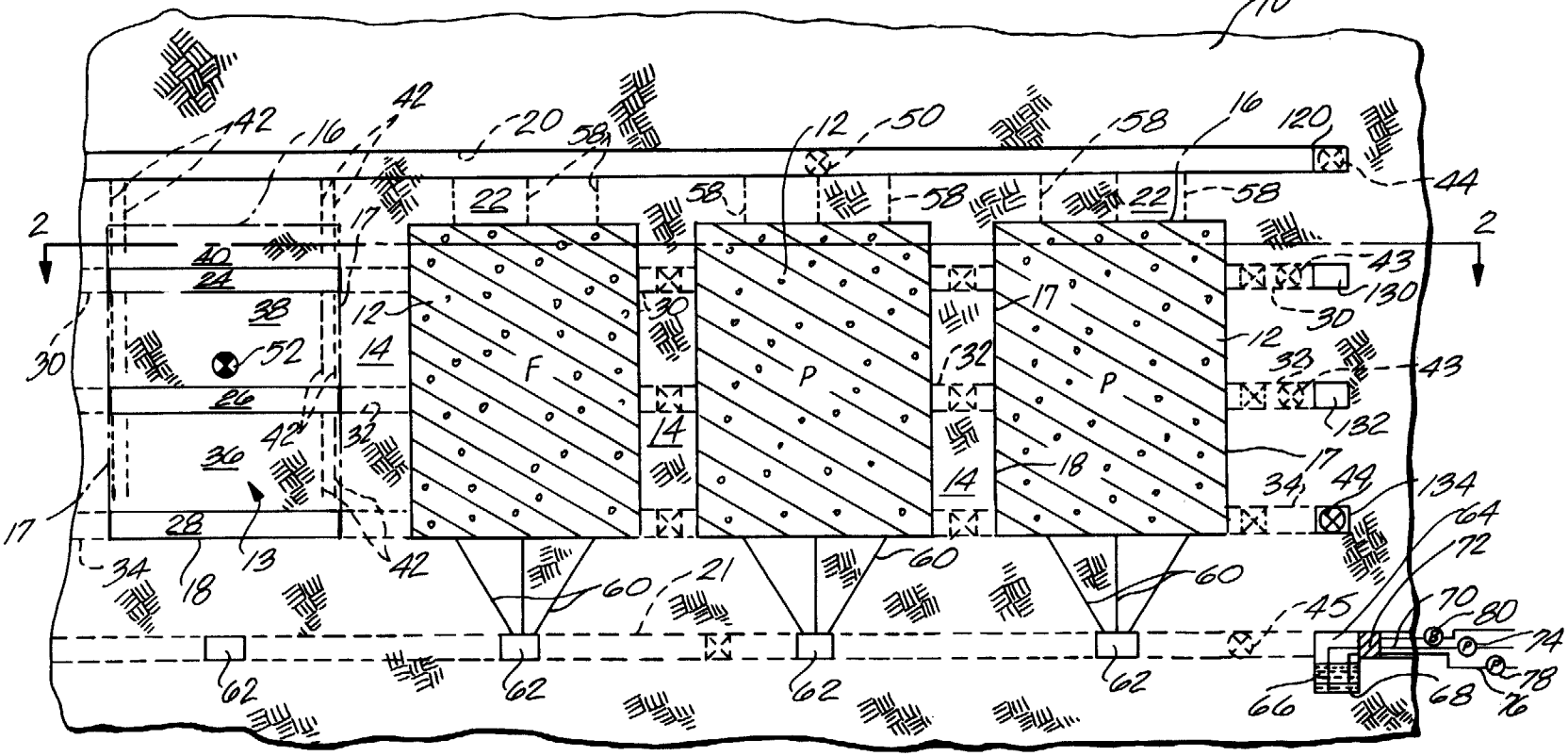
FIG. 1 is a fragmentary, semi-schematic, cross-sectional side view showing a subterranean formation containing oil shale having a plurality of mutually spaced apart in situ oil shale retorts wherein a fragmented permeable mass of formation particles in such a retort protects sensitive equipment in underground workings from seismic shock according to principles of this invention.
Figure 2:
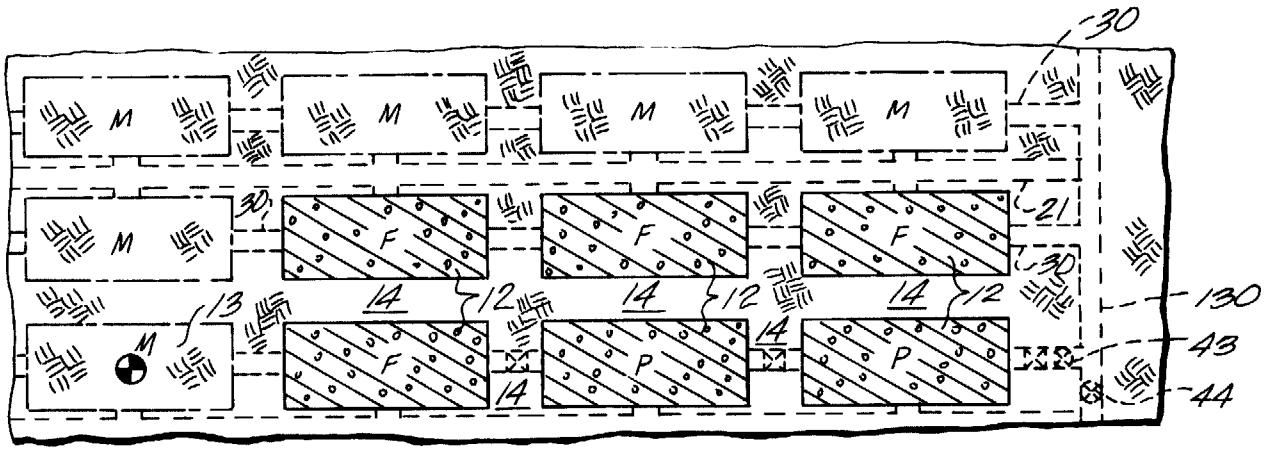
FIG. 2 is a fragmentary, semi-schematic, cross-sectional top view taken on line 2—2 of FIG. 1 and showing a group of in situ oil shale retorts forming a seismic shield according to principles of this invention.

Referring to FIGS. 1 and 2, a system of in situ oil shale retorts is formed in a subterranean formation 10 containing oil shale. Each retort, when completed by explosive expansion techniques, comprises a fragmented permeable mass 12 of formation particles containing oil shale having top, bottom and side boundaries. In one embodiment, the retorts are horizontally spaced apart in parallel rows, leaving vertically extending partitions or gas barriers 14 of unfragmented formation between the fragmented masses 12 in adjacent in situ retorts. Such vertical partitions or walls 14 of unfragmented formation separate the fragmented masses 12 within a given row from one another, as well as separating each fragmented mass in one row from a corresponding fragmented mass in an adjacent row. The gas barriers 14 isolate retorting operations in the respective fragmented masses 12 from one another.

FIGS. 1 and 2 illustrate a system of mutually spaced apart in situ oil shale retorts in the process of being developed. Retorts in the process of being formed, i.e., retorts in a mining region prior to explosive expansion for forming each fragmented mass, are identified in the drawings by the letter "M". Retorts in which formation has been explosively expanded to form a fragmented mass 12, but wherein retorting operations have not begun, are identified in the drawings by the letter "F". Active or producing retorts, in which liquid and/or gaseous products are being produced during retorting operations, are identified in the drawings by the letter "P".

The in situ retorts being formed are rectangular in horizontal cross-section, and as shown in FIG. 1, each retort being formed has a horizontal top boundary 16, four vertically extending side boundaries 17, and a horizontal lower boundary 18. An air level drift 20 is excavated on an upper working level above the retort sites. The floor of the air level drift 20 is spaced above the upper boundary 16 of the retorts being formed, leaving a horizontal sill pillar 22 of unfragmented formation between the bottom of the air level drift 20 and the upper boundary 16 of the retorts being formed. The horizontal extent of the air level drift 20 and other workings on the air level are related to the horizontal cross-section of the retorts being formed so that the air level workings can provide a base of operation for providing effective access to substantially the entire horizontal cross-section of each retort being formed. Such a base of operation provides access for subsequently explosively expanding formation toward one or more voids formed within each retort site. The base of operation also facilitates introduction of oxygen-supplying gas into the top of the fragmented mass 12 formed below the horizontal sill pillar 22.

A production level drift 21 is excavated on a lower working level spaced below the lower boundary 18 of the retort sites. The production level drift 21 is formed below the bottoms of the retorts and between two adjacent rows of retorts, as shown best in FIG. 2 to serve two rows of retorts.

In one mode of retort formation access to each retort site is obtained by retort level access drifts. Thus, in the illustrated embodiment, access to an upper level is obtained by an upper level retort access cross drift 30 extending along the length of each row of retorts. Access to an intermediate level of each retort site is by way of an intermediate level retort access cross drift 32. Access to the lower portion of each retort site is obtained by a lower level retort access cross drift 34 extending along the row of retorts being formed.

The rows of retorts extend between parallel main drift systems at opposite ends of each row. The ends of each air level drift 20 and each production level drift 21 open into a corresponding main air level drift 120 and a main production level drift 121, respectively. Similarly, the ends of the upper, intermediate and lower level retort access cross drifts 30, 32 and 34, respectively, open into corresponding upper, intermediate and lower retort level main access drifts 130, 132 and 134.

In preparing each retort, formation from within the boundaries of each retort site is excavated to form at least one void, leaving a remaining portion of unfragmented formation within the boundaries of the retort being formed. The remaining portion of unfragmented formation is explosively expanded toward such a void for forming the fragmented permeable mass 12 of formation particles containing oil shale in the retort.

In the embodiment illustrated in FIG. 1, three vertically spaced apart, parallel horizontal voids are formed within each retort site. A rectangular upper void 24 is excavated at an upper retort access level with access via an upper level access drift 30. A rectangular intermediate horizontal void 26 is excavated at an intermediate retort access level, and a rectangular lower horizontal void 28 is excavated at a lower retort access level. The horizontal cross-section of each horizontal void is substantially similar to that of the retort being formed. The horizontal voids can include pillars of unfragmented formation for temporary roof support, if desired. Such pillars are not shown in the drawings for simplicity.

In the embodiment shown, a separate retort level access cross drift extends through opposite side boundaries of the retort site at the elevation of each horizontal void, and each of such cross drifts is centered in its respective horizontal void. Thus, the upper level retort access cross drift 30 extends through opposite side walls of the upper level void 24, the intermediate level retort access cross drift 32 opens through opposite side walls of the intermediate level void 26, and the lower level retort access cross drift 34 opens through opposite side walls of the lower level void 28. Such cross drifts provide access for mining equipment used for excavating such voids.

The lower horizontal void 28 is formed at or near the bottom of the retort being formed, and the intermediate horizontal void 26 is spaced above the lower void 28, leaving a lower zone 36 of unfragmented formation between the lower and intermediate voids. Similarly, the upper horizontal void 24 is formed above the intermediate void 26, leaving an intermediate zone 38 of unfragmented formation between the upper and intermediate voids. An upper zone 40 of unfragmented formation remains between the top of the upper void 24 and the top boundary 16 of the fragmented mass being formed.

In a working embodiment, each retort is about 400 feet long by about 150 feet wide in horizontal cross-section. The height of each retort is about 300 to 400 feet, and each horizontal void has a height of about 34 feet, with pillars of unfragmented formation left in each void for temporary roof support. The retorts are formed so that their long axes are parallel to the length of each row of spaced apart retorts, as best illustrated in FIG. 2. Other retort geometries and void geometries can be used in practice of this invention.

The surfaces of unfragmented formation in the zones 36, 38, 40, adjacent the voids 28, 26 and 24, for example, provide horizontal free faces toward which formation is explosively expanded for forming the fragmented permeable mass 12 of formation particles containing oil shale in each in situ report. Further details of techniques for forming retorts using such horizontal void volumes and free faces are more fully described in U.S. Pat. Nos. 4,043,597 and 4,043,598.

After completing a set of upper, intermediate and lower voids in a given retort site, a plurality of mutually spaced apart vertical blasting holes 42 (exemplary ones of which are illustrated in FIG. 1) are drilled in the upper, intermediate and lower zones of unfragmented formation adjacent the horizontal voids. In embodiments where pillars of unfragmented formation are left in the voids, blasting holes also are drilled in the pillars. The blasting holes 42 are loaded with explosive which is detonated in a single round for explosively expanding the zones of unfragmented formation toward the horizontal free faces of formation adjacent the horizontal voids. In a working embodiment, the horizontal voids for many or all retort sites in a given row are initially formed, and explosive in each retort site is detonated in sequence so as to form one retort at a time in such a row, advancing from one end of the row to the other. In the embodiment shown in FIGS. 1 and 2, for example, blasting is advancing from right to left, one retort at a time.

Alternatively, the in situ reports can be formed by excavating at least one vertical columnar void, preferably in the form of a vertical slot (not shown) for providing vertical free faces of formation on opposite sides of the slot in each retort site. Blasting holes are drilled in unfragmented formation adjacent the vertical slot and parallel to such a free face. Explosive in the blasting holes is detonated to explosively expand formation adjacent the slot toward the vertical free faces to form a fragmented permeable mass of formation particles containing oil shale within the in situ retort being formed. Further details of techniques for forming a fragmented mass employing a columnar void are disclosed in U.S. Pat. Nos. 4,043,595 and 4,043,596.

When forming each fragmented mass 12, the entire volume of unfragmented formation remaining within the retort site is explosively expanded in a single round of explosions. Such explosive expansion can involve a powerful explosion causing seismic waves to travel outwardly through the underground formation away from the blast site. For example, in one embodiment of an in situ retort having horizontal cross-sectional dimensions of about 120 feet long and about 120 feet wide, with a height of about 250 feet, approximately 85 tons of explosive are detonated for explosively expanding the entire volume of unfragmented formation remaining within the retort site toward a vertical slot in a single round of explosions. The seismic shock generated by such a large explosion can damage sensitive equipment located in underground workings where seismic shock waves can travel from the blast site on a straight path through unfragmented formation to underground workings where such equipment is located. The present invention provides techniques for shielding equipment from the seismic effects of such large explosions. Equipment which can be protected from seismic shock according to principles of this invention includes process equipment for in situ oil shale retorting which is sufficiently susceptible to seismic shock that it would be damaged or at least adversely affected if subjected to a seismic shock wave traveling directly to such equipment a selected distance through unfragmented formation from an explosion caused by detonating explosive in a single round for forming a fragmented permeable mass of formation particles containing oil shale in an in situ retort spaced from underground workings where such equipment is located. Examples of process equipment which can be damaged if subjected to such seismic shock are blowers, transformers, gas handling equipment, and analytical or monitoring equipment, such as gas chromomatographs, mass spectrometers, and gauges or other similar equipment for measuring, monitoring and/or controlling parameters such as gas flow rate, temperature, pressure, and other aspects of the retorting process, and/or properties of liquid and/or gaseous products produced during retorting operations. Such analytical and monitoring equipment can be housed in trailers located near the sites of active retorts. Rugged mining equipment and the like which could be damaged by rock falls also can be protected as described herein since seismic damage to the walls and roofs of underground workings can occur due to large retort-forming blasts.

According to the present invention, seismic shock waves produced when detonating explosive for forming a fragmented mass in an in situ retort are attentuated by placing such sensitive equipment in underground workings located so that a fragmented mass of formation particles is located between the blast site and the underground workings containing the sensitive equipment. Seismic shock waves which are generated when explosive in the blast site is detonated, and which travel on a straight line through unfragmented formation toward the equipment being shielded, travel through such a fragmented mass prior to reaching the equipment. The fragmented mass dampens the acceleration of shock waves propagated through the underground formation, which attentuates the velocity and magnitude of shock waves that finally reach the underground workings where equipment is located. By attentuating the shock velocity and magnitude of shock waves reaching the vicinity of the equipment, the equipment can be protected from shock damage and rock falls are minimized.

According to practice of this invention, the fragmented mass 12 of a previously formed in situ oil shale retort can provide a seismic shield for attentuating seismic shock produced when detonating explosive for forming an in situ oil shale retort. Such a fragmented mass is confined within surrounding unfragmented formation so as to resist substantial movement from the shock generated when detonating explosive for forming such an in situ retort. By placing sensitive equipment in underground workings located where such a fragmented mass is between the equipment and the blast site, the fragmented mass provides a permeable barrier which is sufficiently large in volume to substantially dampen the acceleration of seismic shock waves traveling through the fragmented mass. This can attenuate the shock velocity and magnitude of seismic waves sufficiently to prevent damage to equipment which would otherwise be damaged, or at least adversely affected from seismic shock traveling directly to such equipment through unfragmented formation. The seismic shield provided by this invention can reduce by a factor of 2 to 3 the ground motion sensed in underground workings adjacent such sensitive equipment as compared with ground motion which would have been produced at the same location by the same seismic shock wave traveling directly through unfragmented formation.

FIG. 1 illustrates several of many possible locations within underground workings where equipment can be placed for protecting it from seismic shock produced when detonating explosive in the retort site 13. Equipment identified by reference numeral 43, for example, can be placed in portions of the upper or intermediate level retort access cross drifts 30 and 32 where the fragmented masses of the producing retorts P and the completed retort F are positioned between such equipment and a blast in the retort site 13. Mining equipment used on these levels can be so placed during a retort-forming blast. As a further example, equipment 44 can be placed in portions of the main air level drift 120 or the main lower level drift 134 where the fragmented masses in the retorts P and F in FIG. 1 can shield such equipment from a blast in the retort site 13. Equipment 45 can also be placed in a portion of the production level drift 21 spaced from the blast in the retort site 13. The equipment 45 in the production level drift 21 is shielded at least partially from a blast in the retort site 13 by the fragmented masses in the producing retorts P and the completed retort F shown in FIG. 1.

According to the present invention, equipment can be protected from seismic shock by placing it in the shadow of at least one fragmented permeable mass of formation particles in a previously formed in situ oil shale retort. By placing such equipment in the "shadow" of a fragmented mass is meant that at least a portion of the intervening fragmented mass is located between the equipment being protected and seismic waves traveling straight toward the equipment from the volume of formation defined by the retort site where the blast occurs. Since the intervening fragmented mass shields the equipment from at least some shock waves generated within the retort site where the blast occurs, the equipment is considered to be in the shadow of the fragmented mass.

Figure 3:
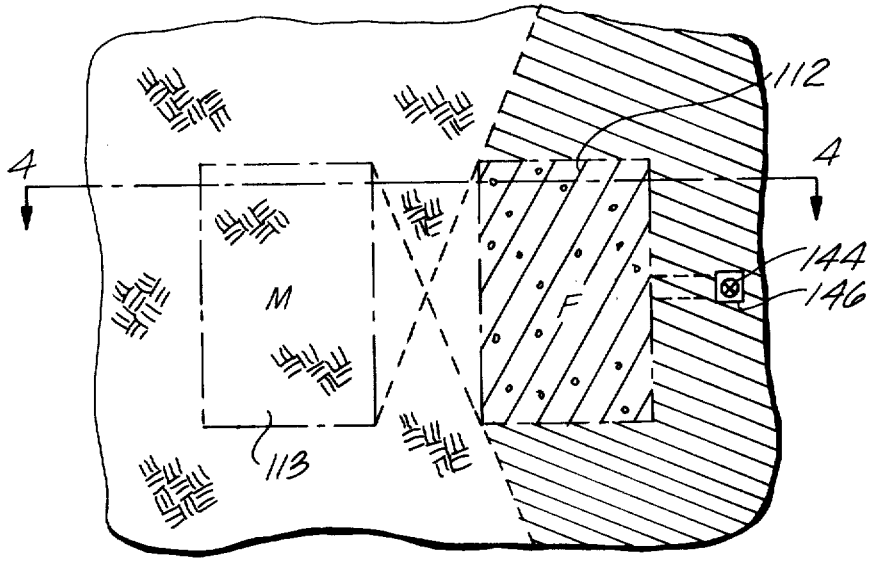
FIG. 3 is a fragmentary, semi-schematic, cross-sectional side view showing sensitive equipment placed in the shadow of a fragmented mass for providing a seismic shield according to principles of this invention.
Figure 4:
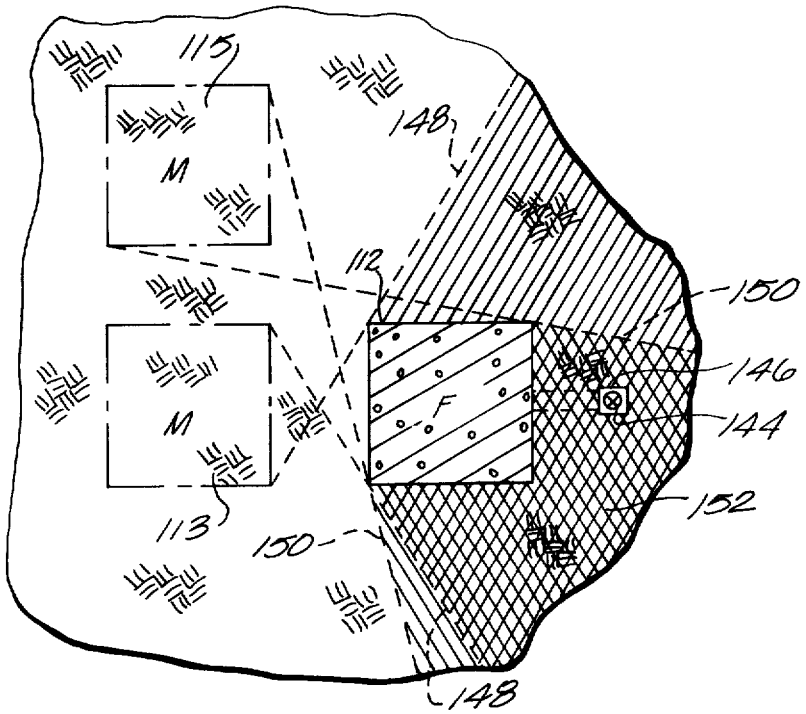
FIG. 4 is a fragmentary, semi-schematic, cross-sectional top view taken on line 4—4 of FIG. 3.

FIGS. 3 and 4 illustrate the shadow or protective region provided by a fragmented mass 112 serving as a seismic shield. The fragmented mass 112 provides a seismic shield for a first blast occurring in an adjacent retort site 113 in the same row as the fragmented mass 112. The fragmented mass 112 also serves as a seismic shield for a separate second blast occurring in a retort site 115 located adjacent the retort 113 in a row adjacent that of the fragmented mass 112. Equipment 144 to be shielded is placed in underground workings 146 located where shock waves generated in either retort site 113 or 115 pass through at least a portion of the intervening fragmented mass 112 prior to reaching such equipment. Referring to FIGS. 3 and 4, the dashed lines 148 and 150 extending from the retort sites 113 and 115 past the fragmented mass 112 indicate the outermost extent of the envelope of seismic shock waves which can travel from each retort site toward the fragmented mass 112 but which are intercepted by the volume occupied by the fragmented mass 112.

The explosive for explosively expanding formation in a retort is distributed in blasting holes throughout the unfragmented formation to be explosively expanded toward the void or voids. Some of the seismic shock, therefore, arises from edges of the retort as well as from the centroid of the explosive in the retort site. For many purposes in estimating seismic shock it can be considered that all of the explosive is concentrated at the centroid (such as the centroid 52 in FIG. 1) of explosive distributed in the retort site. Effective protection of process equipment can be obtained when a permeable seismic shield, such as the fragmented mass of particles in an in situ retort, is interposed in a direct path between the equipment and the site of an in situ retort being formed.

The paths of seismic shock wave travel defined by the dashed lines in FIGS. 3 and 4 thus define the outer extent of the shadow or protective region provided by the fragmented mass 112 for a blast occurring in each retort site 113 or 115. For example, cross-hatching within the dashed lines 148 in FIG. 4 illustrates the shadow or protective region provided by the fragmented mass 112 for a blast occurring in the retort site 113 in the same row as the fragmented mass 112. The cross-hatching within the dashed lines 150 in FIG. 4 illustrates the shadow produced by the fragmented mass 112 for a blast occurring in the retort site 115 in the adjacent row. The cross-hatching in the overlapping area 152 indicates a volume of formation wherein the equipment 144 is at least partially shielded by the fragmented mass 112 from blasts occurring in both retort sites 113 and 115.

Good protection from seismic shock can be provided wherein at least a portion of a fragmented mass intercepts a shock wave traveling on a straight line toward such equipment from a blast site. The shielding effect provided by a fragmented mass can be independent of the amount of fragmented mass between a blast site and sensitive equipment being shielded. For example, a fragmented mass about 50 feet thick can provide substantially the same shielding effect as a fragmented mass 200 feet thick. Ground motion from a shock wave traveling on a straight line can be attenuated by a factor of about 2 to 3 either by passing through only a portion of a fragmented mass, or by passing through the entire width of the same fragmented mass when compared with the ground motion produced by the same shock wave traveling on a straight path through unfragmented formation. Such attenuation is produced by the presence of an interface between a fragmented mass and unfragmented formation through which the shock wave is traveling.

Good protection from seismic shock can be provided when at least a portion of a fragmented mass intercepts a shock wave traveling on a straight line toward sensitive equipment from the centroid of explosive in a retort site where a blast occurs. For example, referring to FIG. 1, equipment 50 to be shielded is located in a portion of the air level drift 20 above the producing retort P located near the retort site 13 where a blast occurs. The envelope of shock waves produced in the retort site 13 is such that some shock waves can travel directly to the equipment 50 through unfragmented formation. The fragmented mass in the retort F adjacent the retort site 13 is located between the equipment 50 and the centroid 52 of explosive within the retort site 13. The fragmented formation particles in the fragmented mass of retort F are present in the path of a shock wave traveling along a straight line from the centroid 52 of explosive in the retort site 13 and the equipment 50, which can provide a sufficient amount of attenuation of shock waves from the retort site 13 to avoid damage to the equipment 50.

FIGS. 1 and 2 illustrate a system of retort development wherein equipment sensitive to seismic shock can be placed in underground workings where such equipment is at least partia ly shielded from blasts occurring in several mutually spaced apart in situ retort sites within a matrix of in situ retorts under development. As best illustrated in FIG. 2, formation is explosively expanded within a series of mutually spaced apart in situ oil shale retort sites to form respective fragmented masses 112, which together provide a permeable buffer zone or seismic shield of fragmented formation particles around a region of formation to be protected from seismic shock. Equipment to be protected in place on one side of the permeable seismic shield provided by the fragmented masses 12 of retorts F in FIG. 2 so that the seismic shield shields such equipment from seismic shock waves generated when subsequently detonating explosive to form fragmented masses in in situ retort sites M on an opposite side of the buffer zone.

In the example illustrated in FIG. 2, the fragmented masses 12 of retorts F nearest a pair of producing retorts P provide a permeable seismic shield around the producing retorts P. The fragmented masses in the seismic shield retorts F can dampen seismic shock waves traveling from the retort sites M toward equipment 43 and 44 located in a retort level access cross drift and a main retort level access drift adjacent the pair of active retorts P. The permeable seismic shield also serves to protect production equipment, bulkheads and the like on the production level from seismic shocks from blasting nearby retorts. Such equipment, for example, can be analytical, monitoring and process control equipment, gauges, and the like placed in trailers adjacent the producing retorts P and used for measuring, analyzing, monitoring and/or controlling selected parameters of the retorting process or of liquid and/or gaseous products produced during retorting operations in the producing retorts P.

EXAMPLE

Figure 5:
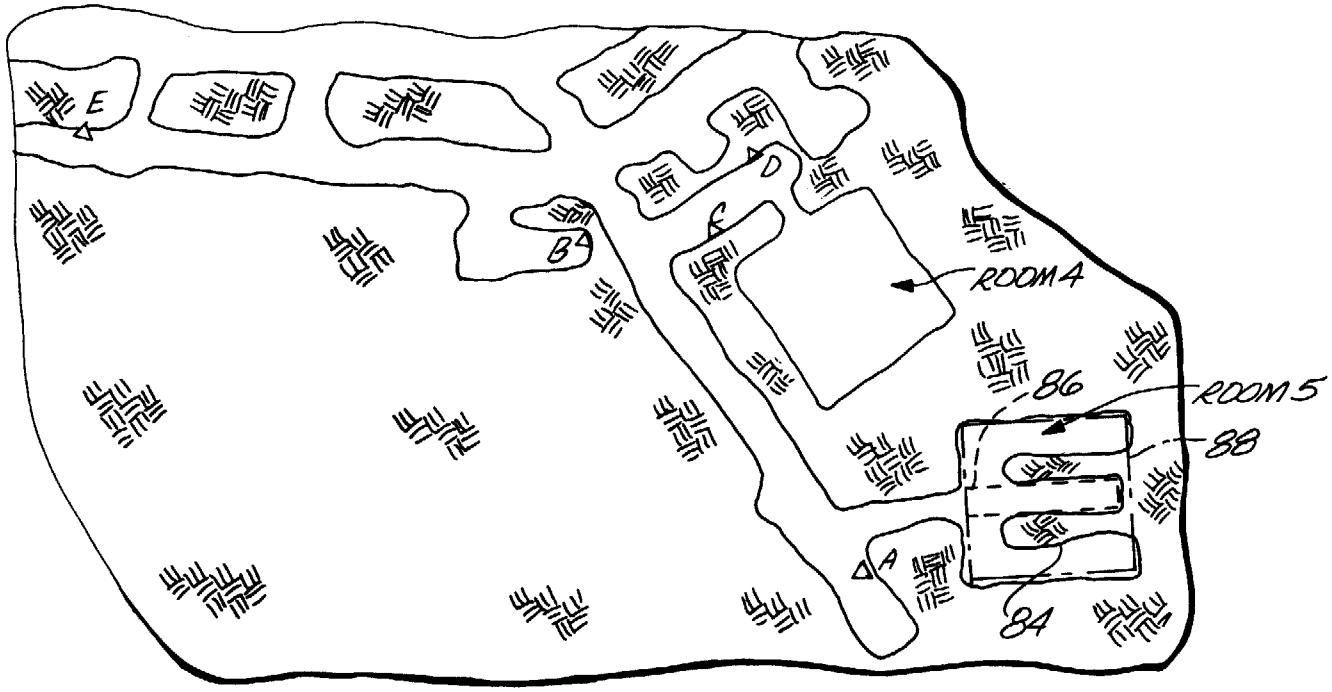
FIG. 5 is a fragmentary, cross-sectional plan view illustrating a pair of experimental in situ oil shale retorts wherein a fragmented mass in one of such retorts provides a seismic shield for an explosion in the other retort according to principles of this invention.

Two in situ oil shale retorts were formed in an experimental project for in situ retorting at Logan Wash in the southwest part of the Piceance Creek Basin, north of DeBeque, Colorado. For convenience, these two in situ oil shale retorts are referred to below as Room 4 and Room 5, respectively. FIG. 5 illustrates a fragment of a map of underground workings at the Logan Wash site illustrating the relative locations of Rooms 4 and 5.

Formation within the Room 4 site was explosively expanded to form a fragmented permeable mass of formation particles containing oil shale in the in situ retort known as Room 4. A fragmented mass in an in situ retort at the Room 5 site was formed after the fragmented mass in the Room 4 retort was formed. A generally E-shaped void 84 was excavated at an upper working level above the top boundary of the retort being formed at the Room 5 site (analogous, for example, to underground workings at the elevation of the air level drift 20 illustrated in FIG. 1). A single vertically extending slot 86 was formed in the center of the Room 5 retort site, and the remaining portion of unfragmented formation within the Room 5 retort site was explosively expanded toward the vertical slot 86 for forming a fragmented permeable mass of formation particles containing oil shale in the Room 5 retort. The outside boundary of the fragmented mass formed at the Room 5 site is illustrated in FIG. 5 by phantom lines at 88. Additional details of techniques used in forming the Room 5 retort are set forth in U.S. patent application Ser. No. 790,350, filed Apr. 25, 1977, by Ned M. Hutchins now U.S. Pat. No. 4,118,071. That application is assigned to the same assignee as this application and is incorporated herein by this reference.

Unfragmented formation in the Room 5 site was explosively expanded toward the vertical slot 86 in a single round of explosions in 20 blasting holes. Approximately 85 tons of explosive were used in the blast, and the blast generated seismic waves traveling outwardly through the formation from the Room 5 site.

Seismic measurements of the Room 5 blast were conducted by measuring ground motion at recording stations in nearby formation at different ranges and directions from the blast site. Ground motion was measured in terms of particle velocity (in inches per second) by velocity gauges embedded in unfragmented formation at the recording stations. Such velocity gauges were piezo-electric accelerometers with an internal integrator output to obtain particle velocity, such gauges being manufactured by Bell and Howell Company. Recording instrumentation for the velocity gauges included a pair of 14-channel tape recorders manufactured by Honeywell, Inc. under Model No. 5600C. Particle velocity is a direct measurement of the shock magnitude sensed at a given location spaced from the blast site, and such measurement provides a good indication of the seismic effect on equipment placed at the location where particle velocity is sensed.

Seismic recording stations identified as Stations A, B, C, D and E in FIG. 5 were at locations corresponding to those shown in FIG. 5. These recording stations were on an upper working level, i.e., at a level above the top of the fragmented masses formed in the Room 5 retort, and corresponding, for example, to the level of the air level drift 20 shown in FIG. 1. Station A was closest to the Room 5 blast site. There was a direct path through unfragmented formation to Station A from the entire volume of formation defined by Room 5. Station B was located near Room 4 and was partially shielded from the Room 5 blast site by the fragmented mass of Room 4. Stations C and D were located on the side of Room 4 opposite the Room 5 blast site so that Room 4 completely shielded Stations C and D from the blast in Room 5. Station E was partially shielded by fragmented mass in Room 4 and was located approximately twice as far from the Room 5 blast site as Station B.

The table below indicates the range of each station from the blast site and summarizes peak particle velocities recorded for the Room 5 blast at Stations A, B, C, D and E. Particle velocity was measured for ground motion in vertical, longitudinal, and/or transverse orientations at the various stations, as indicated by the letters V, L and T, respectively, in the table. The range of each recording station referred to in the table was the horizontal distance to the station from the centroid of the Room 5 blast site. The recorded measurements at Station A, which was located closest to the blast site, gave unreasonable results and therefore are not reported in the table. However, when extrapolating from velocity data recorded at Station A for other blasts in Room 5 (e.g., a blast employed in forming the vertical slot 86) it can be estimated that the peak velocity at Station A for the main blast in Room 5 would have been approximately 70 to 80 inches per second for a vertically oriented velocity gauge.

PEAK VELOCITY SIGNALS FOR ROOM 5 MAIN BLAST

| Station | Range (Ft.) | Peak Amplitude (In/Sec) |
|---|---|---|
| A-V | 145 | — |
| A-L | 145 | — |
| B-V | 400 | 7.3 |
| B-L | 400 | 5.7 |
| B-T | 400 | 7.3 |
| C-V | 320 | 4.0 |
| C-L | 320 | 2.9 |
| D-V | 347 | 2.0 |
| E-V | 800 | 2.2 |
| E-L | 800 | 3.7 |
| E-T | 800 | 3.4 |

The velocity measurements of seismic shock due to the Room 5 blast show that the fragmented mass in the Room 4 retort provided significant attenuation of ground motion or seismic shock in the region of formation shielded by Room 4. For example, Stations B, C and D were located at approximately the same range from the blast site, and Station B was partially shielded by the fragmented mass of Room 4, whereas Stations C and D were completely shielded. The velocity measurements showed that ground motion at Stations C and D was attenuated approximately two to three times as much as ground motion at Station B. The fact that a greater amount of the fragmented mass of Room 4 shielded Stations C and D from the seismic shock due to the blast in Room 5, as compared with the amount of the Room 4 fragmented mass which shielded Station B, is believed to be an important factor in the significantly smaller magnitude of shock sensed at Stations C and D.

The velocity measurement at Station E also demonstrates the significant attenuation of seismic shock provided by the fragmented mass of Room 4. Station E was located approximately twice as far from the Room 5 blast site as Stations C and D. Station E was partially shielded from the Room 5 blast site by only a small portion of the fragmented mass of Room 4, as compared with the completely shielded Stations C and D. The ground motion measurements at Station E were approximately the same magnitude as those at Stations C and D. The amount of attenuation which a shock wave experiences when traveling through unfragmented formation from a blast site to a location spaced from the blast site is inversely proportional to approximately the square of the distance between such a location and the blast site. Since Station E was located approximately twice as far from the Room 5 blast site as Stations C and D, and since ground motion measurements at all three stations were approximately the same, it can be concluded that a fragmented mass in an in situ retort can provide significant attenuation of seismic shock when compared with the amount of attenuation provided over the same distance by unfragmented formation.

Referring again to FIGS. 1 and 2, after the fragmented masses 12 are formed in at least some of the group of retorts, the final preparation steps for producing liquid and gaseous products are carried out. These steps include drilling a plurality of feed gas inlet passages 58 downwardly from underground workings at the elevation of the air level drift 20 to the top boundary of such a fragmented mass so that oxygen-supplying gas can be introduced to each fragmented mass during retorting operations. Alternatively, the upper ends of blasting holes 42 extending through the horizontal sill pillar 22 and used in forming such a fragmented mass can be cleaned and used for introducing gas to the retort. Similarly, a plurality of product withdrawal passages 60 are drilled upwardly from stub drifts 62 adjacent the production level drift 21 to the bottom boundary of each fragmented mass 12. The product withdrawal passages 60 are used for removal of liquid and gaseous products from the retorts to the production level drift 21 below the bottom boundary of the fragmented mass. Alternatively, a portion of each fragmented mass 12 can extend to the production level for passage of liquid and gaseous products. The drilled gas inlet passage 58 and product withdrawal passages 60 can be formed before explosive expansion, if desired.

During retorting operations, formation particles at the top of such a fragmented mass 12 are ignited to establish a combustion zone at the top of such a fragmented mass. Air or other oxygen-supply gas is introduced to the combustion zone from the air level drift 20 through the sill pillar 22 to the top of the fragmented mass. Air or other oxygen-supplying gas introduced to the fragmented mass maintains the combustion zone and avances it downwardly through the fragmented mass. Combustion gas produced in the combustion zone passes through the fragmented mass to establish a retorting zone on the advancing side of the combustion zone wherein kerogen in the fragmented mass is converted to liquid and gaseous products. As the retorting zone moves down through the fragmented mass, liquid and gaseous products are released from the fragmented formation particles.

A sump 64 in a portion of the production level drift system away from the fragmented masses collects such liquid products, namely, shale oil 66 and water 68, produced during operation of the retorts. A water withdrawal line 70 extends from near the bottom of the sump out through an opening in a bulkhead 72 sealed across a production level drift. The water withdrawal line is connected to a water pump 74. An oil withdrawal line 76 extends from an intermediate level of the sump out through an opening in the bulkhead and is connected to an oil pump 78. The oil and water pumps can be operated manually or by automatic controls (not shown) to remove shale oil and water separately from the sump for further processing. Off gas is withdrawn by a blower 80 connected to a conduit sealed through the bulkhead 72. Alternatively, off gas can be withdrawn from the production level drift 21 to a gas collection drift (not shown) at an elevation lower than the elevation of the production level drift 21. Off gas withdrawn from the region of the sump 64 or from such a gas collection drift is passed to aboveground.

The bulkhead, conduits, and other process equipment for withdrawing liquid and gaseous products are within the shadow of already formed retorts so that the effects of seismic shock from detonating explosive in the retort site 13 are attenuated, thereby protecting such process equipment from seismic damage.

Use of a permeable seismic shield between process or mining equipment in underground workings and the site of large retort-forming blasts permits such equipment to be placed much closer to the blasting than is the case when the seismic shock wave travels in a direct line through unfragmented formation between such blasting site and the equipment. This minimizes disruptions in retorting operations during retort formation and can avoid continual moving of equipment to safe locations. For example, equipment sensitive enough to be damaged if located about 750 feet from a retort-forming blast with unfragmented formation between the blast site and the equipment can be left within about 500 feet of such a blast when located behind a permeable seismic shield as described herein.

What is claimed is:

1. A method for attenuating the effects of seismic shock produced by detonating explosive in a subterranean formation containing oil shale for forming a fragmented permeable mass of formation particles containing oil shale in an in situ oil shale retort, the method comprising the steps of:

forming a permeable seismic shield containing a fragmented permeable mass of formation particles;

excavating at least one void in formation containing oil shale within an in situ oil shale retort site, leaving a remaining portion of unfragmented formation within the retort site adjacent such a void;

placing explosive in such a remaining portion of unfragmented formation;

placing equipment to be protected from seismic shock in underground workings spaced a selected distance from the in situ oil shale retort site, such equipment being sufficiently sensitive to seismic shock that it could be damaged if subjected to a seismic shock wave traveling straight to such equipment the selected distance through unfragmented formation from detonation of such explosive, the seismic shield being located at least in part in a direct line between such equipment in the underground workings and the in situ oil shale retort site; and detonating such explosive for explosively expanding such remaining portion of unfragmented formation toward such a void for forming a fragmented permeable mass of formation particles containing oil shale in the in situ oil shale retort, such explosive expansion producing a seismic shock wave at least a portion of which travels through the permeable seismic shield for attenuating the shock velocity and magnitude of the seismic shock wave prior to the shock wave reaching unfragmented formation in the vicinity of the underground workings containing such equipment.

2. The method according to claim 1 wherein the permeable seismic shield comprises a fragmented permeable mass of formation particles confined so as to resist substantial movement from such explosive expansion.

3. The method according to claim 1 wherein the permeable seismic shield comprises a fragmented permeable mass of formation particles containing oil shale in an in situ oil shale retort.

4. The method according to claim 1 including detonating such explosive in a single round.

5. The method according to claim 4 wherein the permeable seismic shield contains a sufficient amount of fragmented formation particles that it reduces by a factor of at least about two the ground motion sensed in such underground workings adjacent such equipment as compared with the ground motion which would have been sensed at the selected distance produced by such a seismic shock wave traveling directly through unfragmented formation.

6. A method for attenuating effects of seismic shock produced by detonating explosive in a subterranean formation containing oil shale for forming a fragmented permeable mass of formation particles containing oil shale in an in situ oil shale retort, the method comprising the steps of:

explosively expanding formation within a first in situ oil shale retort site for forming a first fragmented permeable mass of formation particles containing oil shale in a first in situ oil shale retort;

excavating at least one void in formation containing oil shale within a second in situ oil shale retort site spaced from the first retort site, leaving a remaining portion of unfragmented formation within the second retort site adjacent such a void;

placing explosive in such remaining portion of unfragmented formation;

placing equipment in underground workings located such that the first fragmented mass is positioned between such equipment and the centroid of explosive in the second in situ oil shale retort site, such equipment being sufficiently sensitive to seismic shock that it could be adversely affected if subjected to a seismic shock wave traveling directly to such equipment through unfragmented formation from detonating such explosive in a single round; and detonating such explosive in a single round for explosively expanding such remaining formation in the second retort site toward such a void for forming a second fragmented permeable mass of formation particles containing oil shale in a second in situ oil shale retort, such explosive expansion producing a seismic shock wave which travels from the second retort site through the first fragmented mass for attenuating the shock velocity and magnitude of at least a portion of the seismic shock wave prior to the shock wave reaching unfragmented formation in the vicinity of the equipment.

7. The method according to claim 6 including establishing a retorting zone in the first fragmented mass after the second fragmented mass has been formed for recovering liquid and gaseous products of retorting from the first fragmented mass.

8. The method according to claim 7 wherein such equipment includes means for analyzing liquid or gaseous products of retorting from the first fragmented mass.

9. The method according to claim 6 wherein such underground workings are located a selected distance from the second in situ retort site, and wherein the first fragmented mass contains a sufficient amount of fragmented formation particles that it reduces by a factor of at least about two the ground motion sensed in such underground workings produced from such seismic shock as compared with the ground motion which would have been sensed at the selected distance from the second retort site from such seismic shock traveling directly through unfragmented formation.

10. A method for attenuating effects of seismic shock on process equipment for in situ oil shale retorting wherein such seismic shock is caused by detonating explosive in a subterranean formation containing oil shale for forming a fragmented permeable mass of formation particles containing oil shale in an in situ oil shale retort, the method comprising the steps of:

explosively expanding formation in a first in situ oil shale retort site for forming a first fragmented permeable mass of formation particles containing oil shale in a first in situ oil shale retort;

placing process equipment to be protected from seismic shock in underground workings located in the shadow of the first fragmented mass so that seismic shock waves produced by detonating explosive in a second in situ oil shale retort site spaced from the first fragmented mass travel on a direct path from the second retort site through the first fragmented mass prior to reaching such process equipment, wherein such process equipment is susceptible to damage due to seismic shock waves traveling directly to such equipment through unfragmented formation from explosive detonated for forming a fragmented permeable mass of formation particles containing oil shale in such a second in situ oil shale retort; and detonating explosive in the second in situ oil shale retort site for explosively expanding formation within the second retort site for forming a second fragmented permeable mass of formation particles containing oil shale in such a second in situ oil shale retort, such explosive expansion producing seismic shock waves traveling toward such equipment through the first fragmented mass for attenuating the seismic effect on such equipment.

11. The method according to claim 10 including establishing a retorting zone in the first fragmented mass after the second fragmented mass has been formed for recovering liquid and gaseous products of retorting from the first fragmented mass.

12. The method according to claim 10 including detonating such explosive in a single round for forming the second fragmented mass.

13. The method according to claim 10 including excavating at least one void in the second retort site, leaving a remaining portion of unfragmented formation within the second retort site adjacent such a void; and detonating explosive in such a remaining portion of formation in a single round for forming the second fragmented mass.

14. The method according to claim 10 wherein such underground workings are located a selected distance from the second in situ retort site; and wherein the first fragmented mass attenuates by a factor of at least about two the ground motion in such underground workings produced by the seismic shock waves when compared with ground motion which would have been sensed at the selected distance from such seismic shock waves traveling directly through unfragmented formation.

15. A method for protecting process equipment used for in situ oil shale retorting from damage caused by detonating explosive when forming a fragmented permeable mass of formation particles containing oil shale in an in situ oil shale retort, the method comprising placing process equipment sensitive to seismic shock in underground workings located so that a first fragmented permeable mass of formation particles containing oil shale in a first in situ oil shale retort is interposed in a direct path between such equipment and a centroid of explosive in unfragmented formation within a second in situ oil shale retort site spaced from the first fragmented mass, and detonating such explosive in the second in situ retort site in a single round for explosively expanding formation in the second retort site for forming a second fragmented permeable mass of formation particles containing oil shale in a second in situ oil shale retort, such explosive expansion producing a seismic shock wave which travels from the second retort site through the first fragmented mass to attenuate the shock velocity and magnitude of the seismic shock wave prior to the shock wave reaching unfragmented formation in the vicinity of the underground workings containing such process equipment.

16. The method according to claim 15 wherein the equipment is sufficiently sensitive to seismic shock that it could be adversely affected if subjected to a seismic shock wave traveling directly to such equipment through unfragmented formation from explosive detonated within the second retort site in a single round for forming the second fragmented mass.

17. The method according to claim 15 wherein such underground workings are located a selected distance from the second in situ retort site, and wherein ground motion in such underground workings is attenuated by a factor of at least about two when compared with such a seismic shock wave traveling such a selected distance directly through unfragmented formation.

* * * * *